United States Patent [19]

Hostetter

[11] 4,278,132

[45] Jul. 14, 1981

[54] PROPORTIONING APPARATUS

[76] Inventor: Morgan D. Hostetter, 2442 James Ave., West Covina, Calif. 91791

[21] Appl. No.: 40,646

[22] Filed: May 21, 1979

[51] Int. Cl.[3] ..... A62C 35/00

[52] U.S. Cl. ..... 169/13; 137/897; 169/15; 169/30; 222/334; 239/67; 239/310

[58] Field of Search ..... 169/13, 14, 15, 30; 137/604, 896, 897; 222/57, 61, 63, 334, 468, 383; 239/67, 68, 310; 417/46, 326, 375

[56] References Cited

U.S. PATENT DOCUMENTS

| | | | |
|---|---|---|---|
| 548,780 | 10/1895 | Eads | 169/15 |
| 1,691,374 | 11/1928 | Birkenmaier | 222/61 X |
| 2,354,634 | 7/1944 | Griswold | 222/63 |
| 2,623,469 | 12/1952 | Gray | 222/63 X |
| 2,696,266 | 12/1954 | Tuve | 169/14 |
| 2,763,513 | 9/1956 | Paradise | 222/334 X |
| 3,337,195 | 8/1967 | Farison | 169/15 X |
| 3,776,468 | 12/1973 | Davenport | 239/310 |
| 3,997,080 | 12/1976 | Langstroth | 222/61 |

*Primary Examiner*—Robert J. Spar
*Assistant Examiner*—Edward M. Wacyra
*Attorney, Agent, or Firm*—Sellers and Brace

[57] ABSTRACT

Apparatus for introducing a widely variable predetermined quantity of liquid from a non-pressurized source into a flowing stream of a pressurized fluid. The unitary apparatus is readily detachably assembled to bulk shipping containers of different sizes and its pneumatically powered proportioning mechanism is quickly adjustable at will to pressurize and dispense a liquid at a selected one of many different precise rates into a pressurized fluid stream. The apparatus is readily and quickly adjusted to operate at a wide range of pressures and at many hundreds of pounds per square inch and to vary the ratios of the two fluids between one part in 1,000 and one part in 40,000. The proportioner has many applications including dispensing a fire fighting agent into a pressurized water line supplying fire hoses.

24 Claims, 4 Drawing Figures

PROPORTIONING APPARATUS

This invention relates to fluid proportioning devices, and more particularly to a simple, rugged fluid proportioner for introducing widely and quickly variable quantities of a fluid from an unpressurized source into a flowing stream of another fluid even though the latter be highly pressurized.

BACKGROUND OF THE INVENTION

There are numerous environments having need for intermixing two or more fluids in precisely controlled ratios including some where it is essential to provide for varying the proportions over a small if not a large range including commercial, industrial, construction, etc. illustrative of the latter environments is fire fighting equipment making use of one of the numerous fire fighting chemicals. Typically, a relatively small quantity of the chemical is required and this must be introduced from a non-pressurized container into a flowing stream of water customarily at high pressure under conditions positively safeguarding against backflow of chemical into the water supply source, particularly where the water is derived from a municipal water distribution system. Apparatus previously proposed for this and related purposes is disclosed in the following U.S. Pat. Nos.: Eads, 548,780; Sargeant, 2,543,941; Hachmeister, 2,558,681; Granberg, 2,567,997; Goodman, 3,549,048; Langstroth, 3,997,080; 3,073,256. The proportions disclosed in each of these prior proposals are subject to numerous disadvantages and shortcomings. Typically, the proposals utilize the main line water pressure to power a pump for raising the chemical agent to a suitable pressure for introduction into the main water stream. Additionally, these prior constructions lack adequate and satisfactory means for proportioning the two fluids. Some lack means of any character for varying the proportions of water and the chemical or other agent. Those having flow rate varying means have an extremely limited range of adjustability. Another disadvantageous characteristic of prior designs is the use of energy derived from the flow of one of the fluids to drive a pump operable to introduce one fluid into the first stream. This mode of driving the pump has the obvious disadvantage of impeding the flow of the first fluid and necessitates the use of a costly fluid motor in the main fluid line. It has also been proposed to place the chemical in a flexible walled envelope housed within a main housing sufficiently strong to withstand the main line pressure. Pressurization of the chemical in this manner is utilized to introduce the chemical into the main line through a calibrated orifice. This expedient is obviously unreliable for lack of a pressure differential across the orifice. It is also necessary to substitute different orifices in order to vary the flow of the chemical constituent. Another proportioner utilizes an electric motor to drive a pair of positive displacement pumps connected in series. One of these pumps is used to circulate a liquid in a closed circuit including an adjustable relief valve bypassing a selected portion of the liquid back to the source and the remainder being used to operate a diaphragm pump connected in circuit with the chemical actually being introduced into a second fluid in a desired proportion. This complex and costly system is disclosed in U.S. Pat. No. 3,073,256.

SUMMARY OF THE INVENTION

This invention avoids the numerous shortcomings and disadvantages characterizing prior proposals for fluid proportioning devices. Extremely wide-range precise variable proportioning is accomplished in an unusually facile and accurately controlled manner using a micro-metering valve to control the flow of pressurized air to a pneumatic motor directly coupled to a positive displacement pump. The inlet to this pump is connected to a non-pressurized source of fluid and its outlet is connected to a stream of pressurized fluid through an adjustable pressure relief valve which opens only when the pump discharge pressure exceeds that of the line into which the fluid is being introduced. No electrical power is required, all operating energy being supplied from a source of pressurized air. If the major fluid pressure is quite high it is desirable to drive the positive displacement pump through a single and even a double speed reduction. The limited number of small components involved are preferably mounted in a unitary assembly quickly detachably installable on any of different types and sizes of bulk shipping containers for the chemical or other fluid being introduced into a second fluid. In a typical illustrative operating environment the proportioning unit is utilized as a sub-assembly of fire fighting equipment such as a water pumper. The pressurized air facilities of such fire equipment is utilized to operate the proportioner to dispense a fire fighting chemical into the pressurized water line supplying one or more hoses. Adjustment of the micro metering valve in the air line readily varies the quantity of chemical introduced into the water line over a range of one part to 1,000 and one part to 40,000 parts.

Accordingly, it is a primary object of this invention to provide a unique foolproof rugged highly-efficient self-contained fluid proportioning apparatus adjustable over a wide range of relative flow rates.

Another object of the invention is the provision of a unitary proportioning apparatus readily adjustable to introduce one fluid into another over a wide range of readily controlled ratios.

Another object of the invention is the provision of a fluid proportioning apparatus having a pressurizing fluid delivery unit driven at any of a wide range of speeds by a variable speed pneumatic motor.

Another object of the invention is the provision of fluid proportioning apparatus readily adjustable to introduce one fluid into a second fluid at ratios varying between one and 1,000 parts and one and 40,000 parts.

Another object of the invention is the provision of fluid proportioning apparatus readily detachably installable on a bulk shipping container for one of the fluids.

Another object of the invention is the provision of a fluid proportioning apparatus for introducing a fire fighting chemical into a pressurized water line in any of a wide range of ratios utilizing a source of pressurized air on the fire fighting equipment.

Another object of the invention is the provision of a mobile water pumper with a pneumatically-powered fluid proportioning device effective to introduce a fire fighting chemical from an unpressurized source into pressurized water being circulated by the pumper to one or more dispensing nozzles.

These and other more specific objects will appear upon reading the following specification and claims and upon considering in connection therewith the attached drawing to which they relate.

Referring now to the drawing in which a preferred embodiment of the invention is illustrated:

Figure 1:
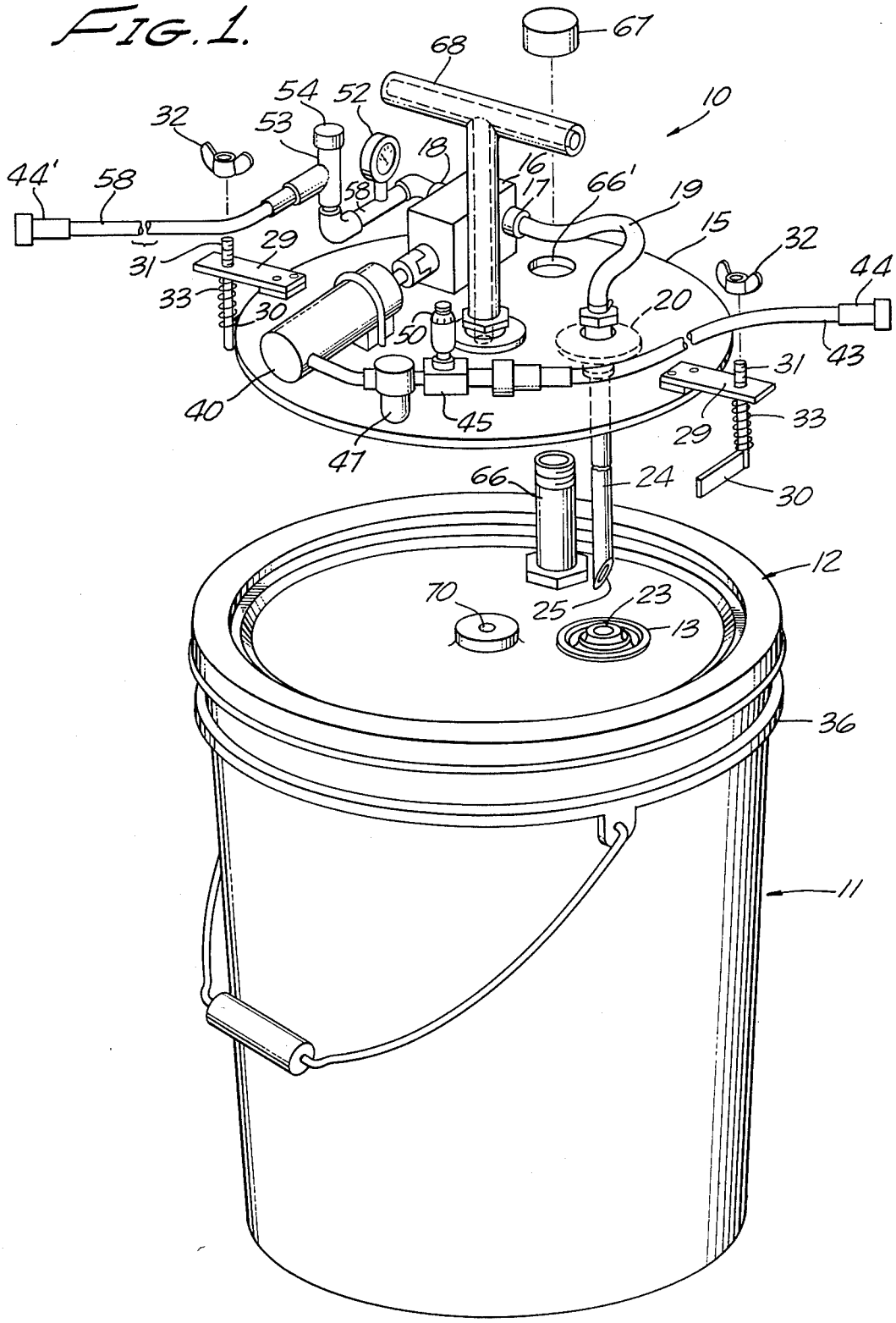
FIG. 1 is an exploded perspective view of an illustrative embodiment of the invention proportioning apparatus detached from a bucket-type shipping container for a fluid to be introduced in a selected proportion into a pressurized fluid.
Figure 2:
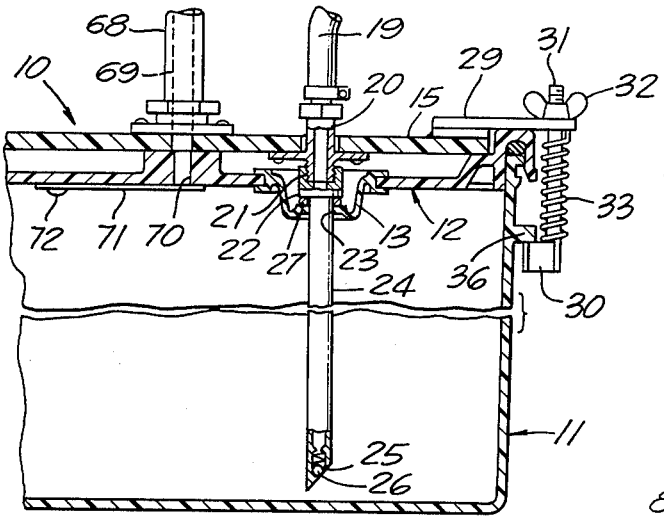
FIG. 2 is a fragmentary vertical sectional view through the proportioner attached to a bucket-type shipping container.
Figure 3:
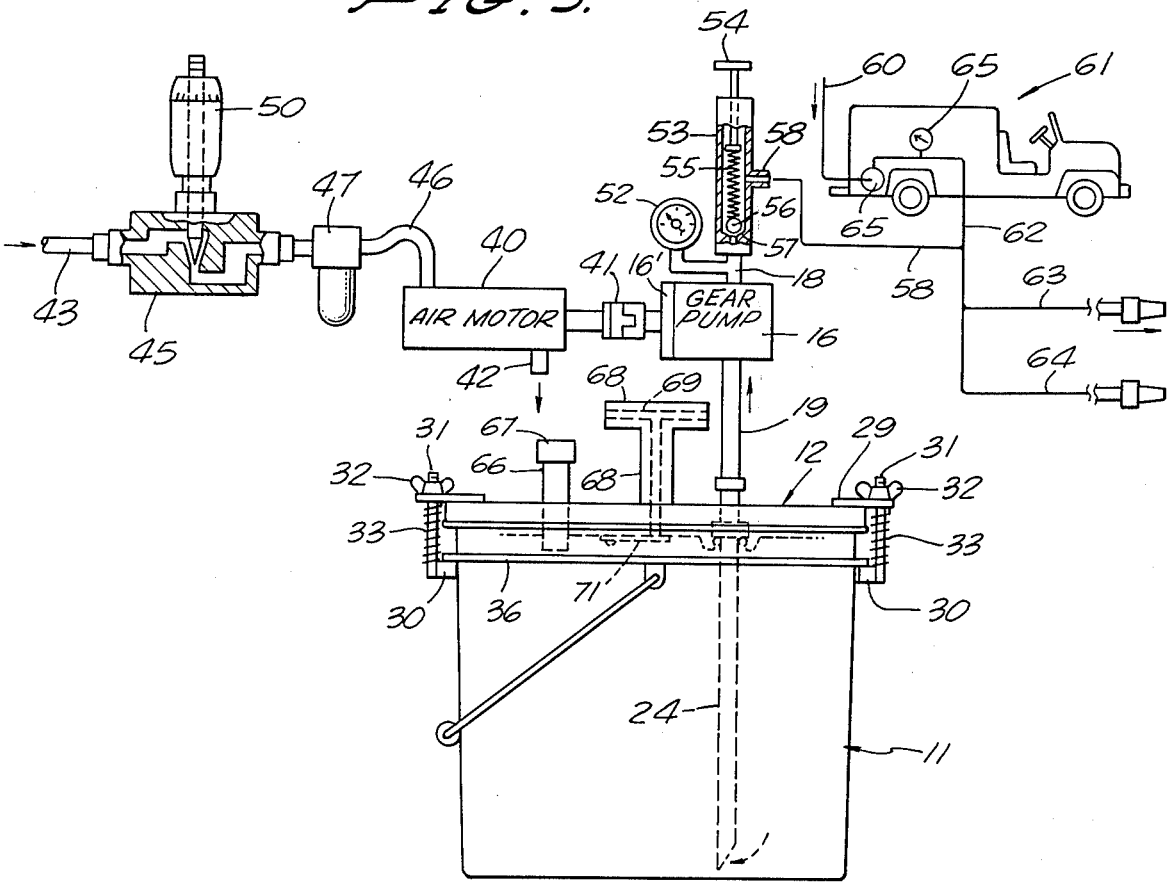
FIG. 3 is a diagrammatic view of the apparatus shown in FIG. 1 connected to a main water line of a mobile fire fighting pumper connected to one or more fire fighting hose lines.

Referring more particularly to FIGS. 1, 2 and 3, the proportioning apparatus, designated generally 10, is shown about to be secured to a conventional plastic shipping container 11 having a snug fitting detachable cover 12 provided with a plastic retractable-extendable pouring spout 13 with a prebored outlet 23. This outlet is closed by a cap, not shown, until the proportioner is attached thereto. The exterior of this spout is usually threaded to mate with a plastic cap, not shown.

The unitary proportioning apparatus 10 includes a rigid circular base 15 formed of any suitable material such as a tough plastic. Suitably secured to base 15 is a positive displacement gear pump 16 having an inlet 17 and an outlet 18. The pump drive shaft preferably includes a single or a double stage speed reducer 16'. Inlet 17 is connected by flexible hose 19 to a threaded fitting 20 passing through an opening in base 15 and suitably secured thereto. The threaded lower end 21 of this fitting mates with a coupling 22 carried by the upper end of the suction tube 24. This tube extends through the outlet 23 of the flexible pouring spout 13. The lower end 25 of the suction tube 24 is equipped with a normally closed check valve 26 which normally traps the contents of tube 24 when the proportioning apparatus is not in use. A sealing gasket such as an O-ring 27 encircles inlet tube 24 and is held seated against the upper end of the pouring spout 13 when the apparatus is clamped to the cover 12.

The means for detachably clamping the proportioning unit 10 to container 11 includes a pair of brackets 29 anchored to and projecting from the opposite sides of base 15. Rotatably mounted in openings at the outer ends of these brackets are L-shaped clamping jaws 30 which are equipped at the upper end of leg 31 with a thumb nut 32. A torsion spring 33 encircles leg 31 and its upper end being anchored in bracket 29 and its lower end bearing against jaw 30 so as to bias the jaw outwardly away from the flange 36, encircling and integral with the wall of container 11 when the thumb nuts are loosened. Accordingly, loosening of the thumb nuts 32 allows the jaws to pivot outwardly away from annular flange 36. When both jaws are loosened, proportioning unit 10 can be lifted upwardly to withdraw the suction tube 24 from the pouring spout 13. It will be understood that this pouring spout is of a conventional design and includes threads on its exterior which mate with the threads of a removable cap, not shown, for spout opening 23.

Pump 16 is driven by an air motor 40 to which it is coupled by a flexible coupling 41. Motor 40 can be connected to a source of pressurized air by a flexible hose 43 preferably provided at its inlet end with a conventional fast action coupling 44 (FIG. 1). Mounted in hose 43 is a manually adjustable micro-metering valve 45 and a lubricator 47. Valve 45 is of a well known conventional type having a valve stem the upper end of which is encircled by ten different colored bands exposed in succession by a single revolution of the circular control dial 50 which is sub-divided into 100 increments. Accordingly, the ten rotations of control dial or ring 50 suffice to open the valve into any selected one of one thousand different positions thereby metering pressurized air at an equal number of different rates to motor 40. The exhaust air is vented to the atmosphere through outlet duct 42.

The pump outlet conduit 18 is provided with a pressure guage 52 and an adjustable back-flow preventer valve 53. The latter includes an adjustable thumb nut 54 for adjusting the pressure on a calibrated compression spring 55 normally holding ball valve 56 seated on valve seat 57. As shown in FIG. 3, the outlet hose 58 of back-flow preventer 53 opens into the manifold 62 on the discharge side of pump 65 of a mobile fire fighting pumper 61. The pump inlet is connected to pipe 60 representing a pressurized water supply line such as a municipal water supply system. Pumper 61 is illustrative of the type commonly employed to increase the pressure of water being distributed by manifold 62 to a number of hoses 63, 64 to fight a fire. Manifold 62 is customarily equipped with a pressure gauge 65. By visually comparing gauges 52 and 65 the operator can make certain that back flow preventer 53 is set to open at a pressure higher than that in manifold 62. This assures that proportioner 10 is functioning to deliver chemical from reservoir 11 to the manifold. However, it is optional with the user to feed the chemical into either inlet or outlet side of the pump.

Any of various well known chemicals useful in controlling fires of different character may be introduced into the pressurized water line 60 by the fluid proportioner of this invention. These include foaming agents, wetting agents, fire retardants and other chemicals well known to those skilled in the fire fighting art. Illustrative of these is a wetting agent available on the market and which, in combination with water, has highly superior characteristics in penetrating blazing materials, knocking down combustion, and cooling burning material below the rekindling point. Burning combustibles are almost instantly and deeply penetrated, moistened and cooled by the water rendering the material non-combustible. In particular water containing the wetting agent cools and extinguishes hot embers which would otherwise resume open burning long after fire fighters were of the belief that fire had been extinguished. Portions of the wetting agent as small as one part to 40,000 parts of water are found highly effective for these and related purposes although for some types of fires a concentration of wetting agent as high as one part in 1,000 parts of water are found adequate and highly beneficial.

It will be recognized that the proportioner herein described is suitable for introducing one fluid into another in ratios widely differing from those just mentioned; these particular ratios are readily achieved using the device as herein described and equipped with a micro-metering valve 45 adjustable to any one of a thousand different positions.

The back-flow preventer 53 remains closed until and unless the chemical or other fluid being pumped from container 11 reaches a predetermined pressure controlled by adjusting the position of the rotary thumb nut 54. When the proportioner is used with fire fighting equipment the discharge water pressure of the pumper may be varied widely depending on local conditions and the type of fire being fought. For example, the pumper discharge may be as high as 600 psi, but regardless of the prevailing pressure thumb nut 54 is adjusted so that valve 56 does not open until the discharge pressure of pump 16 exceeds the pressure of the fluid present in the line into which the fluid from reservoir 11 is being introduced. Typically the adjustment is made so that valve 56 opens at a pressure slightly greater than that in manifold 62 with the result that the fluid from container 11 is being introduced at a steady rate at a ratio controlled by the setting of needle valve 50 regulating the speed of motor 40 and pump 16.

Some users prefer to refill smaller shipping containers. This is accommodated by providing the bucket cover 12 with a refilling accessory or pipe 66 having a removable cap 67. The refilling accessory extends loosely through an opening 66' in the proportioner base 15.

Rigidly secured to the center of base 15 is a tubular T-shaped handle 68 useful in lifting the proportioner 10 by itself or together with container 11 when the proportioner is secured thereto by clamps 29, 30. Passage 69 in handle 68 communicates with a vent hole 70 in cover 12. This vent is normally closed by a leaf spring 71 secured to the cover as by rivet 72 (FIG. 2).

Figure 4:
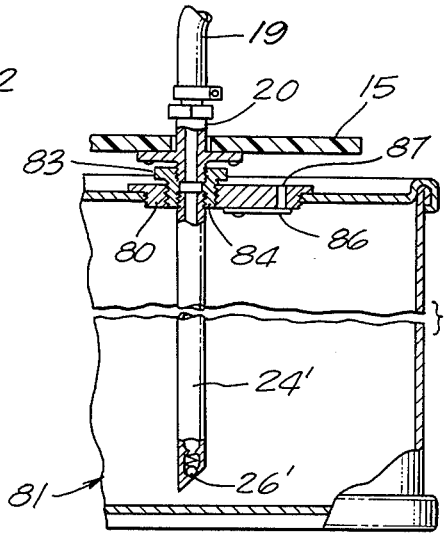
FIG. 4 is a fragmentary cross sectional view of a portion of the proportioner installed on a plastic drum shipping container.

FIG. 4 illustrates proportioner 10 detachably mounted in and rigidly supported by the bung 80 of a conventional plastic shipping drum 81. The relatively short suction duct 24 and coupling 21 described in connection with FIGS. 1 to 3 are detached and replaced with a bushing 83 and a longer suction pipe 24'. This bushing is screwed into the threaded bore 84 provided therefor in bung 80. It will be noted that bung 80 is provided with a normally closed leaf spring 86 closing the air vent 87. The lower end of suction pipe 24' is preferably provided with a check valve 26' which opens in response to the suction pressure of pump 16 to admit fluid from container 81. However, when the pump is not in operation the fluid in tube 24' remains trapped and instantly available when the pump starts. When the pump is not operating the proportioner 10 may be removed from the drum without risk of loss of the fluid contents of duct 24' or possible injurious consequences to the operator and surrounding objects.

The operation of the proportioner will be readily apparent from the foregoing detailed description of its components. If the device is installed in a small capacity container, such as a five gallon plastic bucket 11, the sealing gasket 27 seats about the inlet pipe 24 and against the top of the cover to provide a fluid tight connection as the attaching clamps 30, 32 are tightened. The fast action coupling 44 for the air inlet hose 43 is then coupled to a source of pressurized air and the similar fast action coupling 44' in the outlet hose 58 is coupled to a second fluid line, such as the water manifold 62. The equipment is placed in operation by rotating the control dial 50 to open needle valve 45 and admit pressurized air to motor 40. The needle valve is appropriately calibrated in accordance with the fluid to be dispensed with the result that opening of the valve to a pre-selected position admits air to drive motor 40 and pump 16 at an appropriate speed to inject fluid from container 11 into manifold 62 at a predetermined precise rate. If a multiple stage speed reducer is employed, the operating speed of the pump may range between 5 and 1100 r.p.m. and develop a pump discharge pressure of 800 psi, or more. Fluid from container 11 cannot escape past valve 56 until its pressure rises to a predetermined level slightly in excess of that present in the distributing manifold 62. Since the needle valve 45 is accurately calibrated to operate the air motor at the appropriate speed to deliver the required quantity of the first fluid into manifold 62 at the desired rate there is no need for a pressure relief valve or a return conduit to container 11.

If it is desired to use the proportioner with a larger shipping container for the chemical it is a simple matter to mount the proportioner in a large capacity shipping drum 81 simply by detaching the suction pipe 24 and substituting an adaptor bushing 83 and a longer suction duct 24'. These fittings are sufficiently strong to support the rugged light weight proportioner from the drum bung 80 thereby dispensing with the need for clamps 30, 32.

While the particular proportioning apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A unitary fluid proportioning apparatus for introducing a readily varied quantity of a first fluid from a non-pressurized source thereof into a pressurized second fluid at any selected one of a wide range of pressures each substantially higher than the pressure of said second fluid comprising:

positive-displacement pump means powered independently of the pressure of said second fluid and having an intake connectable to said non-pressurized source of said first non-pressurized fluid and an outlet connectable to said pressurized second fluid via manually adjustable back flow preventer means designed to open at a selected one of said wide range of predetermined pressures each greater than that of said pressurized second fluid; and valve means for regulating the operating speed of said pump means between a few rpm and many hundreds of rpm to vary the flow rate of said first fluid into said pressurized second fluid.

2. Fluid proportioning apparatus as defined in claim 1 characterized in the provision of releasable clamp means carried by said unitary apparatus for detachably anchoring the latter as a unit exteriorly of the cover of a storage container for said first fluid, and the intake means for said pumping means including duct means adapted to extend through an opening in the wall of said container.

3. Fluid proportioning apparatus as defined in claim 2 characterized in the provision of fluid sealing means embracing said duct means and adapted to be pressed into sealing contact with the container wall opening when said apparatus is clamped to said container.

4. Fluid proportioning apparatus as defined in claim 1 characterized in that said pump means includes speed reducing gear means effective to drive said positive displacement pump means very substantially slower than the power drive therefor.

5. Fluid proportioning apparatus as defined in claim 1 characterized in that said unitary apparatus includes a base plate underlying and rigidly secured to said power driven pump means and adapted to overlie the cover of a conventional bucket type shipping container for said first fluid.

6. Fluid proportioning apparatus as defined in claim 5 characterized in the provision of hand grip means rigidly secured to said unitary apparatus to facilitate the handling thereof of said apparatus and a shipping container for said first fluid when attached thereto.

7. Fluid proportioning apparatus as defined in claim 5 characterized in the provision of manually manipulatable clamping means mounted on opposite peripheral edges of said base plate including clamping jaws adapted to engage beneath the outwardly extending flange embracing the top of a conventional bucket-type shipping container.

8. Fluid proportioning apparatus as defined in claim 1 characterized in that the power drive for said pump means comprises a pneumatic motor having an air inlet equipped with an adjustable needle valve to regulate the speed of said pneumatic motor.

9. Fluid proportioning apparatus as defined in claim 1 characterized in that said power driven pump means is operable at any selected speed ranging between about 5 r.p.m. and 1100 r.p.m.

10. Fluid proportioning apparatus as defined in claim 1 characterized in that said power driven pump means is selectively operable to vary the rate of flow of said first fluid into said pressurized second fluid between 1 part in 1,000 parts and 1 part in 40,000 parts.

11. Fluid proportioning apparatus as defined in claim 10 characterized in that said first fluid is a wetting agent and said pressurized second fluid is water at a pressure ranging as high as 800 psi.

12. Fluid proportioning apparatus as defined in claim 1 characterized in the provision of means for releasably mounting said unitary proportioning apparatus exteriorly of a shipping container and in a threaded opening in the bung of a shipping container.

13. Fluid proportioning apparatus as defined in claim 12 characterized in the provision of a normally closed air inlet valve in said bung.

14. That improvement in self-powered mobile fire fighting unit of the type having a motor-driven water pump and a power driven source of pressurized air thereon which improvement comprises:

fluid proportioning means for introducing a fire fighting agent from a non-pressurized container into pressurized water being pumped by said water pump at a regulatable pressure substantially higher than the discharge pressure of said water pump, said fluid proportioning means including positive displacement pump means having an inlet connected to said non-pressurized container and an outlet connected to pressurized water flowing through the outlet of said water pump and including manually adjustable back-flow preventer means on the discharge side of said positive displacement pump means operable to open when the pressure of said fire fighting agent has been increased to any of a range of values greater than the water pressure at the outlet of said water pump and air motor means driving said positive displacement pump independently of the operation of said water pump by pressurized air from said source of pressurized air on said mobile fire fighting unit.

15. That improvement defined in claim 14 characterized in that said fluid proportioning means comprises a unitary assembly having duct connections with said pressurized air source and with the pressurized water flowing through said water pump and with the fire fighting agent in said non-pressurized container, and means for detachably clamping said unitary assembly to an opening in the wall of said container while dispensing fluid therefrom.

16. That improvement defined in claim 15 characterized in that said container for a fire fighting agent is a shipping container for said agent storable on said mobile fire fighting equipment until the contents thereof have been expended.

17. That improvement defined in claim 15 characterized in that said means for detachably clamping said unitary proportioning assembly to a container includes means for supporting said unitary proportioning assembly on and exteriorly of a bung of said container.

18. That improvement defined in claim 15 characterized in that said detachably clamping means include bushing means detachably mountable in a container bung.

19. That improvement defined in claim 14 characterized in the provision of means for refilling said container with a fire fighting agent while said unitary assembly remains clamped thereto.

20. That improvement defined in claim 14 characterized in the provision of adjustable micrometer valve means controlling the flow of pressurized air to said air motor means and thereby operable to vary the flow rate of said fire fighting agent into the water being pumped by said water pump.

21. That improvement defined in claim 14 characterized in the provision of means for controlling the speed of said air motor means thereby to vary, at the user's option, the flow of said fire fighting agent into the pressurized water over a range including 1 part agent to 6,000 to 12,000 parts of water.

22. That method of intermixing two fluids over a wide range of differing proportions which consists of:

utilizing a manually regulatable supply of pressurized air to drive a positive displacement pump over a wide range of differing speeds to withdraw a first fluid from a non-pressurized source thereof and pressurizing the same to any selected one of a wide range of pressures each greater than the pressure of a flowing pressurized stream of a second fluid, and introducing said pressurized first fluid into said flowing pressurized stream of said second fluid so long as the pressure of said first fluid is in excess of the pressure of said second fluid, and varying the supply of pressurized air driving said positive displacement pump as necessary to vary the proportions of said first fluid intermixed with said flowing stream of said second fluid.

23. A unitary fluid proportioning apparatus consisting of:

a variable speed air-driven positive displacement gear pump provided with means for quickly detachably mounting said apparatus across the top of a closed shipping container chargeable with a liquid to be dispensed therefrom and including an inlet duct insertable through an access opening of the aforementioned shipping container;

pressurized liquid outlet passage means for said pump including manually adjustable spring-biased check valve means therein operable to open to release liquid from said pump at any of a wide range of predetermined pressures each in excess of the pressure of a second liquid with which said first mentioned liquid is to be mixed; and manually adjustable means for supplying pressurized air to said air-driven pump at different rates and pressures to vary the operating speed thereof.

24. Flow proportioning apparatus for introducing one fluid into a flowing stream of a pressurized liquid in a desired relative ratio from a non-pressurized source of said one fluid which consists of:

a gaseous fluid-driven positive displacement pump having an inlet connectable with an unpressurized source of said one fluid;

needle valve means for varying the supply of pressurized gaseous fluid to said fluid-driven pump to vary the pumping rate of said one fluid and to pressurize the same to a predetermined pressure of several hundred psi; and flow passage means for connecting the outlet of said pump to a flowing stream of said liquid pressurized to a value below said predetermined pressure of said one fluid, said flow passage means including manually adjustable spring-biased valve means normally biased closed and operable to open only when and so long as the pressure of said one fluid on the outlet side of said pump exceeds said predetermined pressure.

* * * * *